US008492321B2

(12) United States Patent
Goujon et al.

(10) Patent No.: US 8,492,321 B2
(45) Date of Patent: Jul. 23, 2013

(54) USE OF AN OLIGOMER-BASED ADDITIVE FOR STABILIZING A LUBRICATING COMPOSITION FOR A CONVEYOR CHAIN

(75) Inventors: Gerard Goujon, Conflans Saint Honorine (FR); Florence Severac, Gargenville (FR); Marc Borel-Garin, Paris (FR)

(73) Assignee: NYCO S.A., Paris (FR)

( * ) Notice: Subject to any disclaimer, the term of this patent is extended or adjusted under 35 U.S.C. 154(b) by 120 days.

(21) Appl. No.: 13/123,068

(22) PCT Filed: Oct. 7, 2009

(86) PCT No.: PCT/FR2009/051919

§ 371 (c)(1),
(2), (4) Date: Apr. 7, 2011

(87) PCT Pub. No.: WO2010/040960

PCT Pub. Date: Apr. 15, 2010

(65) Prior Publication Data

US 2011/0195886 A1 Aug. 11, 2011

(30) Foreign Application Priority Data

Oct. 10, 2008 (FR) ..... 08 56872

(51) Int. Cl.
*C10M 133/12* (2006.01)

(52) U.S. Cl.
USPC ..... 508/563

(58) Field of Classification Search
USPC ..... 508/563
See application file for complete search history.

(56) References Cited

U.S. PATENT DOCUMENTS

| | | | | |
|---|---|---|---|---|
| 3,509,214 | A | 4/1970 | Braid et al. | |
| 5,160,647 | A | 11/1992 | Odorisio et al. | |
| 5,489,711 | A | 2/1996 | Lai | |
| 6,372,698 | B1 | 4/2002 | Strothoff et al. | |
| 6,426,324 | B1 * | 7/2002 | Lai et al. | 508/563 |
| 6,548,455 | B1 | 4/2003 | Sperling et al. | |
| 7,053,026 | B2 | 5/2006 | Li | |
| 2004/0014611 | A1 | 1/2004 | Li | |

OTHER PUBLICATIONS

International Search Report, dated Jan. 28, 2010, from corresponding PCT application.

* cited by examiner

*Primary Examiner* — Prem C Singh
*Assistant Examiner* — Francis C Campanell
(74) *Attorney, Agent, or Firm* — Young & Thompson

(57) ABSTRACT

The use of an additive including a mixture of oligomers that is produced from the reaction of aromatic amines chosen from:

(i) the reaction with one another of diphenylamine (DPA) compounds of formula (I) below:

(I)

wherein the groups $R_1$ and $R_2$ stand for, independently of one another, a hydrogen or a linear or branched alkyl group having from 1 to 30 carbon atoms, advantageously from 4 to 12 carbon atoms, (ii) the reaction with one another of phenyl-α-naphthylamine (PAN) compounds of formula (II) below:

(II)

wherein the group $R_3$ stands for a hydrogen or a linear or branched alkyl group having from 1 to 30 carbon atoms, advantageously from 4 to 12 carbon atoms, and (iii) the reaction of a (DPA) compound of formula (I) above with a (PAN) compound of formula (II) above as an agent for the stabilization of a lubricating composition for a conveyor chain subjected to a temperature of at least 120° C.

14 Claims, 5 Drawing Sheets

USE OF AN OLIGOMER-BASED ADDITIVE FOR STABILIZING A LUBRICATING COMPOSITION FOR A CONVEYOR CHAIN

FIELD OF THE INVENTION

The present invention relates to the field of lubricants for conveyor chains, in particular for conveyor chains subjected to high temperatures.

STATE OF THE ART

Conveyor belt systems are widely used in industrial production lines, to transport equipment parts or objects that are in process from a point of departure to a point of destination, typically from a first workstation to a second workstation.

Displacement of the conveyor belts is generally performed by means of belts or conveyor chains which in turn are driven through rotating pulleys.

To lower the mechanical force that is required for moving the conveyor belts and at the same time to slow down the conveyor chain wear, the conveyor chains are being continuously lubricated, as described for example in the American patents no U.S. Pat. Nos. 6,548,455 and 6,372,698.

Generally speaking, a good lubricant for a conveyor chain has a good adhesion to metals, a capacity to lubricate elements which are continuously under friction and a good resistance to thickening.

In some industrial fields, as for example in glass industry, in industrial bakery, in paint drying ovens, in glass wool and rock wool manufacturing, in production of cans or beverage cans, in cement industry or in automotive industry, parts or objects in process are submitted to one or more thermal treatment steps, by running through an oven. In these industrial fields, wherein conveyor systems are submitted to high temperatures, the conveyor chains have to be lubricated with oils that retain their properties when submitted to high temperatures, often higher than 150° C.

Under such high temperature working conditions, the lifetime of mineral oil-based lubricants revealed insufficient to be compatible with the technical and economical requirements of the conveyor system maintenance. Also, under the same conditions, lubricants based on poly-α-olefins (PAO) were not compatible, because of the formation of PAO residues which leads to the formation of hard deposits adhering to the surface of the conveyor chain mechanical parts.

As a rule, lubricating compositions withstanding high temperatures for a conveyor chain should be at the same time characterized by:

- a low weight loss over a long period of time,
- the preservation of the desired viscosity over a long period of time, and
- a quick decomposition leading to a moderate formation of residual deposits.

It should be noted that lubricants for conveyor chains are initially applied on the whole chain length thanks to suitable distributor systems. Thereafter the lubricated chain is set in continuous motion and undergoes another lubrication cycle when the initially applied lubricant has lost its lubricating properties. It is to be understood that the continuous operation of the conveyor belts requires that the used lubricant generates as few residual degradation compounds as possible, so as to avoid each new lubrication cycle to be preceded by a cleaning cycle of the conveyor chain.

Such mechanical constraint does not exist in the field of motor lubricants flowing from a carter through oily fluid closed-loop systems. In this different technical field, the used lubricant is then simply drained out and the carter is supplied with some fresh lubricant again.

Heat-stable oils are known from the state of the art for a conveyor chain, which are made of combinations of a mineral oil and polyol ester-based oils. The heat stability of such lubricating mixtures is higher than the heat stability of each of the mineral or synthetic oils considered in isolation. This type of lubricating compositions may further comprise various additives, such as antioxidants, detergents, dispersants, antiwear agents, viscosity modifiers, antifoams, corrosion inhibitors, etc. In particular such heat-stable oils may comprise antioxidants selected from sulfur-containing compositions, aromatic amines, phenols, or even from liposoluble compounds containing transition metals, as is described for example in the American patent no U.S. Pat. No. 7,053,026 (The Lubrizol Corporation).

However there is a constant need for lubricating compositions for conveyor chains submitted to high temperatures, that would represent either alternatives or improvements as compared to existing lubricating compositions.

SUMMARY OF THE INVENTION

The present invention relates to the use of an additive comprising a mixture of oligomers that is produced from the reaction of aromatic amines selected from:

(i) the reaction of diphenylamine (DPA) compounds with each other, the said diphenylamine (DPA) compounds having the formula (I) below:

(I)

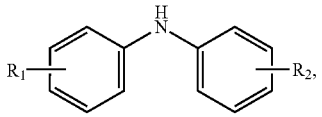

wherein the groups $R_1$ and $R_2$ stand for, independently of one another, a hydrogen or a linear or branched alkyl group having from 1 to 30 carbon atoms, advantageously from 4 to 12 carbon atoms, (ii) the reaction of phenyl-α-naphthylamine (PAN) compounds with each other, the said phenyl-α-naphthylamine (PAN) compounds having the formula (II) below:

(II)

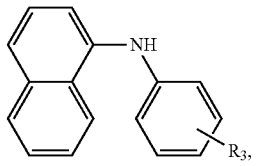

wherein the group $R_3$ stands for a hydrogen or a linear or branched alkyl group having from 1 to 30 carbon atoms, advantageously from 4 to 12 carbon atoms, and (iii) the reaction of a (DPA) compound of formula (I) above with a (PAN) compound of formula (II) above as an agent for the stabilization of a lubricating composition for a conveyor chain subjected to a temperature of at least 120° C.

The lubricating composition is preferably chosen from synthetic ester-based oils.

In particular, the lubricating composition is suitable for lubricating a conveyor chain subjected to a temperature of at least 150° C., more preferably of at least 180° C. and even more preferably of at least 200° C.

DETAILED DESCRIPTION OF THE INVENTION

Figure 1:
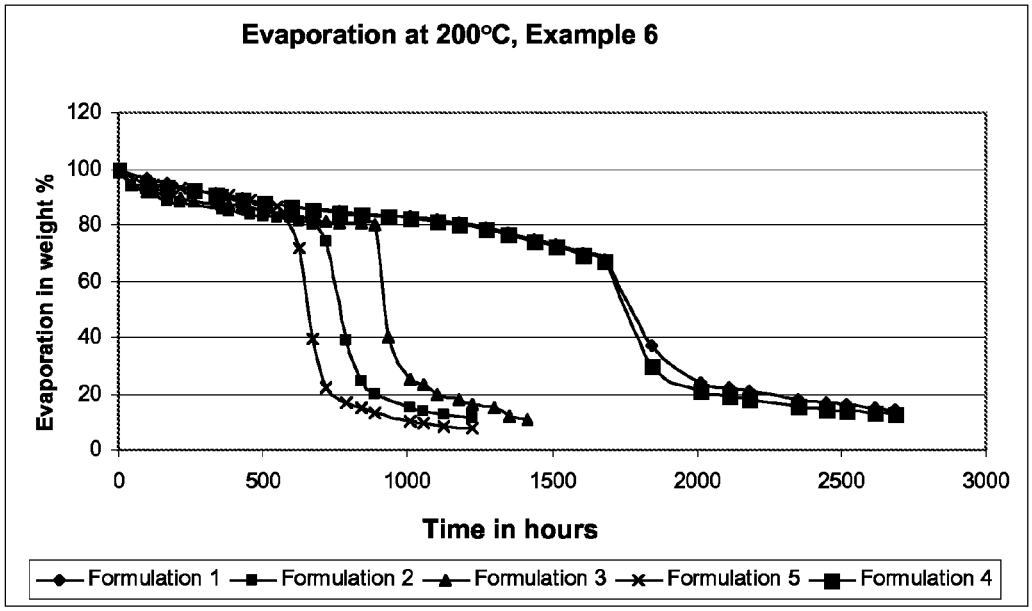
FIG. 1 illustrates the comparison between the evaporation curves of four lubricating compositions of the invention based on polyol esters, and a comparative lubricating composition (having no mixture of oligomers) based on the same polyol esters. On the abscissa: the time of exposure at high temperatures (200° C.), in hours. On the ordinates: the degree of evaporation, in residual weight percentage of the relevant composition relative to the weight at time 0 of the same composition.

Surprisingly, it has been shown according to the invention that heat stability properties of a lubricating composition for a conveyor chain could be improved by incorporating into the oil one additive containing oligomers made of (i) diphenylamine units or derived from diphenylamine, (ii) of phenyl-α-naphthylamine units or derived from phenyl-α-naphthylamine, or (iii) of a combination of units (i) and (ii);

Surprisingly, it has been shown according to the invention that adding an oligomer-based composition such as described above enables to obtain a lubricating composition for a conveyor chain which retains its lubricating power over a long period of time.

It is an object of the present invention to provide the use of an additive comprising a mixture of oligomers that is produced from the reaction of aromatic amines selected from:

(i) the reaction of diphenylamine (DPA) compounds with each other, the said diphenylamine (DPA) compounds having the formula (I) below:

(I)

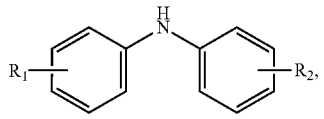

wherein the groups $R_1$ and $R_2$ stand for, independently of one another, a hydrogen or a linear or branched alkyl group having from 1 to 30 carbon atoms, advantageously from 4 to 12 carbon atoms, (ii) the reaction of phenyl-α-naphthylamine (PAN) compounds with each other, the said phenyl-α-naphthylamine (PAN) compounds having the formula (II) below:

(II)

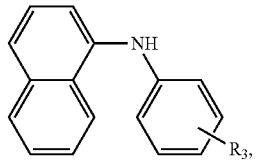

wherein the group $R_3$ stands for a hydrogen or a linear or branched alkyl group having from 1 to 30 carbon atoms, advantageously from 4 to 12 carbon atoms, and (iii) the reaction of a (DPA) compound of formula (I) above with a (PAN) compound of formula (II) above as an agent for stabilizing a lubricating composition for a conveyor chain subjected to a temperature of at least 120° C.

Some of the additives of the type of those defined hereabove are known from the state of the art for their application to stabilize high temperature oils in gas turbines for aircraft engines. In this known application, it had been shown that such additives have antioxidant and/or anti-corrosion properties and that they can reduce variations in the acid acid. In the prior application, the presence of such additives caused a gradual increase in the viscosity of the lubricant together with the working time, especially because of the progressive evaporation over time of the most volatile fractions in the lubricating oil. In these applications, the quality of the lubricating composition is controlled at regular intervals and an excessive increase in the viscosity value or in the acid value causes the draining and the change of said lubricant to be done.

According to the invention it has been shown that the first characteristic which is generally sought for a lubricant to be used in a conveyor chain working at high temperatures, that is to say an evaporation that is significantly delayed in time, could be improved by adding the hereabove additive, as compared to the evaporation observed with a comparative lubricant which does not contain said additive. As is shown in the examples, adding the hereabove additive to a lubricating composition enables under some circumstances to double the lifetime of the lubricating composition at high temperatures, as compared to a comparative lubricant not containing said additive.

It has also been shown that, with the additive such as described above, the service life at high temperatures can be significantly extended because of the delay of the moment wherein a strong increase in the viscosity, which results from the polymerization of the compounds contained in the oil, can be observed, which is materialized by the gelling of the lubricating composition leading to an almost total loss of its lubricating power.

In addition, it has also been shown in the examples that adding an additive such as described above enables to obtain a lubricating composition that can rapidly decompose, without leaving onto the conveyor chain components a residual amount of deposit higher than that observed with a comparative lubricant not containing said additive.

These properties of the hereabove additive for lubricating compositions for use in a conveyor chain at high temperatures are very surprising in view of what effects the one skilled in the art could expect from the addition of oligomers.

In particular, it is unexpected that adding oligomers that are known for inducing an increase in viscosity in lubricants for aircraft turbines does not induce any significant change in the service life at high temperatures before gelling, as compared to lubricating compositions that do not contain these oligomers, and especially as compared to comparative lubricating compositions comprising aromatic alkyl amine monomers.

It is even more surprising that the use of an oligomer-containing additive composition (i) comprising DPA oligomers, (ii) PAN oligomers or (iii) DPA and PAN oligomers, does not lead to an increase in the amount of decomposition residues of the lubricating composition on the surface of the conveyor chain components, as compared to the amount of residual compounds found after having used a lubricating composition which does not contain said additive, and especially after having used a comparative lubricating composition comprising aromatic alkyl amine monomers.

Thus, it has been shown according to the invention that adding an additive agent containing (i) DPA oligomers, (ii) PAN oligomers or (iii) DPA and PAN oligomers to a lubricating composition for a conveyor chain provides said lubricating composition with:

a high thermal stability illustrated through a reduced, almost nil, weight loss (evaporation), for an extended period of use at high temperatures, which causes the lubricating properties of the oil composition to be retained for an extended period of time and an optimal level of protection for the various parts of the conveyor chain, and after an extended period of use at high temperatures, a high decomposition rate, without solid carbonaceous deposits that might incrust between the conveyor chain parts and block the motion thereof.

As used herein, an "alkyl", especially for compounds of formulas (I) and (II), as previously defined, means a linear or branched chain of a saturated monovalent hydrocarbon radical having the specified number of carbon atoms. In a branched alkyl group, the linear hydrocarbon chain is substituted with one or more alkyl groups. Alkyl groups include especially butyl, pentyl, hexyl and octyl groups.

In some embodiments of the stabilizing agent for a high-temperature conveyor chain, the groups $R_1$ and $R_2$ of the diphenylamine compound (DPA) are the same.

Diphenylamine (DPA) compounds include diphenylamine, dioctylphenylamine, didecylphenylamine, didodecylphenylamine or even dihexylphenylamine.

In some embodiments of the stabilizing additive agent for a high-temperature conveyor chain, the groups $R_1$ and $R_2$ of the diphenylamine compound (DPA) each consist in an octyl group and DPA consists in di-octyl di-phenylamine or DODPA, well known from the person skilled in the art.

Phenyl-α-naphthylamine compounds include especially phenyl-α-naphthylamine, para-tertio-octylphenyl-α-naphthylamine, para-tertio-dodecylphenyl-α-naphthylamine and para-tertio-butyl-α-naphthylamine.

In some embodiments of the stabilizing agent, the group $R_3$ of the phenyl-α-naphthylamine (PAN) compound consists in an octyl group and PAN consists in octyl-phenyl-α-naphthylamine or N-(para-tertio-octylphenyl)-α-naphthylamine, also abbreviated OPAN, well known from the person skilled in the art.

Generally, DPA compounds of formula (I) and PAN compounds of formula (II) are products that are commonly available on the market.

Preferably, a DPA compound of formula (I) wherein the groups $R_1$ and $R_2$ each consist in an octyl group is used, and DPA consists in di-octyl phenylamine or DODPA, well known from the person skilled in the art.

Preferably, a PAN compound of formula (II) is used, wherein the group $R_3$ consists in an octyl group and PAN consists in octyl-phenyl-α-naphthylamine or N-(para-tertio-octylphenyl)-α-naphthylamine, also abbreviated OPAN, well known from the person skilled in the art.

In other embodiments, a PAN compound of formula (II) wherein $R_3$ is hydrogen may be used. PAN stands then for phenyl-α-naphthylamine.

The method for preparing the mixture of oligomers that constitutes the additive of the invention will be described in more details hereunder in the present specification.

Generally, the additive used according to the present invention comprises a mixture of oligomers which qualitative and quantitative composition is as follows:

(a) from 0% to 30% by weight of diphenylamine of formula (I),
(b) from 0% to 25% by weight of phenyl-α-naphthylamine of formula (II),
(c) from 1% to 95% by weight of oligomers in the form of dimers,
(d) from 0% to 95% by weight of oligomers in the form of trimers,
(e) from 0% to 50% by weight of oligomers in the form of tetramers,
(f) from 0% to 30% by weight of oligomers in the form of pentamers,
(g) from 0% to 15% by weight of oligomers in the form of hexamers,
(h) from 0% to 10% by weight of oligomers in the form of heptamers or oligomers with a higher degree of polymerization, the percentages by weight being expressed relative to the total weight of components (a) to (h).

In certain embodiments, the additive used according to the present invention comprises a mixture of oligomers which qualitative and quantitative composition is as follows:

(a) from 0% to 30% by weight of diphenylamine of formula (I),
(b) from 0% to 25% by weight of phenyl-α-naphthylamine of formula (II),
(c) from 1% to 95% by weight of oligomers in the form of dimers,
(d) from 0% to 45% by weight of oligomers in the form of trimers,
(e) from 0% to 45% by weight of oligomers in the form of tetramers,
(f) from 0% to 30% by weight of oligomers in the form of pentamers,
(g) from 0% to 15% by weight of oligomers in the form of hexamers, (h) from 0% to 10% by weight of oligomers in the form of heptamers or oligomers with a higher degree of polymerization, the percentages by weight being expressed relative to the total weight of components (a) to (h).

In other embodiments, the additive used according to the present invention comprises a mixture of oligomers which qualitative and quantitative composition is as follows:

(a) from 0% to 30% by weight of diphenylamine of formula (I), (b) from 0% to 25% by weight of phenyl-α-naphthylamine of formula (II), (c) from 1% to 95% by weight of oligomers in the form of dimers, (d) from 0% to 45% by weight of oligomers in the form of trimers, (e) from 0% to 35% by weight of oligomers in the form of tetramers, (f) from 0% to 30% by weight of oligomers in the form of pentamers, (g) from 0% to 15% by weight of oligomers in the form of hexamers, (h) from 0% to 10% by weight of oligomers in the form of heptamers or oligomers with a higher degree of polymerization, the percentages by weight being expressed relative to the total weight of components (a) to (h).

Examples of stabilizing additives of the invention prepared by reaction of a (DPA) compound of formula (I) with a (PAN) compound of formula (II) are described in Examples 1 and 3.

In the embodiments of the invention wherein said additive consists in a product resulting from the reaction of (DPA) compounds of formula (I) with each other, said additive comprises a mixture of oligomers which qualitative and quantitative composition is as follows:

(a) from 0% to 30% by weight of diphenylamine of formula (I), (b) from 0% to 1% by weight of phenyl-α-naphthylamine of formula (II), (c) from 1% to 95% by weight of oligomers in the form of dimers of DPA, (d) from 0% to 45% by weight of oligomers in the form of trimers of DPA, (e) from 0% to 35% by weight of oligomers in the form of tetramers of DPA, (f) from 0% to 30% by weight of oligomers in the form of pentamers of DPA, (g) from 0% to 15% by weight of oligomers in the form of hexamers of DPA, (h) from 0% to 10% by weight of oligomers in the form of heptamers of DPA or oligomers with a higher degree of polymerization, wherein the percentages by weight are expressed relative to the (a)-(h) components total weight.

Generally, for obtaining the stabilizing additives consisting in a DPA reaction product, one may react up to three distinct DPA compounds of formula (I) with each other, and advantageously two distinct DPA compounds of formula (I). Preferably, said stabilizing additives are the products of the reaction of molecules of a single DPA compound of formula (I) with each other. An illustration of how to prepare a stabilizing additive of the invention by making DPA compounds of formula (I) react with each other is described in Example 2.

In the embodiments of the invention wherein said additive consists in a product of reaction of a (PAN) compound of formula (II), said additive comprises a mixture of oligomers which qualitative and quantitative composition is as follows:

(a) from 0% to 1% by weight of diphenylamine of formula (I), (b) from 0% to 25% by weight of phenyl-α-naphthylamine of formula (II), (c) from 1% to 95% by weight of oligomers in the form of PAN dimers, (d) from 0% to 45% by weight of oligomers in the form of PAN trimers, (e) from 0% to 35% by weight of oligomers in the form of PAN tetramers, (f) from 0% to 30% by weight of oligomers in the form of PAN pentamers, (g) from 0% to 15% by weight of oligomers in the form of PAN hexamers, (h) from 0% to 10% by weight of oligomers in the form of PAN heptamers or oligomers with a higher degree of polymerization, wherein the percentages by weight are expressed relative to the total weight of components (a)-(h).

In a general manner, for obtaining the stabilizing additives consisting in a product of reaction of PAN, one may react up to three (PAN) compounds of formula (II) with each other, and advantageously two distinct (PAN) compounds of formula (II). Preferably, said stabilizing additives are the products of the reaction of molecules with each other of a single (PAN) compound of formula (II). An illustration of how to prepare a stabilizing additive of the invention by making PAN compounds of formula (II) react with each other is described in Example 4.

In some embodiments, the mixture of oligomers of the invention may be obtained through an oligomerization reaction of DODPA with a PAN compound of formula (II) chosen from OPAN and phenyl-α-naphthylamine.

Generally, the qualitative and quantitative composition of a stabilizing agent of the invention may be easily determined by the person skilled in the art, by means of any known method. For example, the person skilled in the art may use a high-performance liquid chromatography (HPLC) or even a vapor-phase chromatography. The person skilled in the art may also use a supercritical fluid chromatography (SFC).

In some embodiments of the stabilizing agent of the invention, said agent is essentially free of, or as an alternative totally free of, any detectable amount of organic peroxide, including alkyl peroxide, and specifically, di-tert-butyl peroxide, as well as products from the decomposition thereof, as for example tert-butanol.

In some embodiments of the antioxidizing agent of the invention, said agent may contain detectable traces of potassium permanganate or even the reduction products thereof. The content may be measured by flame ionization spectrometry (through inductively coupled plasma—ICP).

In some embodiments, the additive or stabilizing agent of the invention comprises, in addition to the (i) DPA oligomers, (ii) PAN oligomers or (iii) DPA and PAN oligomers, some amount of a DPA or PAN monomer. As is shown in the examples, the presence of DPA or PAN monomers in combination with (i) DPA oligomers, (ii) PAN oligomers or (iii) DPA and PAN oligomers enables however to obtain an additive having the expected stabilizing properties for a high temperature lubricating composition for a conveyor chain.

Preferably, the stabilizing additive of the invention comprises at most 25% by weight of DPA or PAN, relative to the total weight of the hereabove defined (a)-(h) components. In some embodiments, the stabilizing additive comprises less than 1% by weight of DPA or PAN, relative to the total weight of the hereabove defined (a)-(h) components. In some embodiments, said stabilizing additive comprises 0% by weight of DPA or PAN, relative to the total weight of the hereabove defined (a)-(h) components. In these latest embodiments, said additive does not contain any amount of DPA measurable by means of the hereabove mentioned chromatography methods.

In some embodiments, the additive or stabilizing agent of the invention comprises, in addition to the (i) DPA oligomers, (ii) PAN oligomers or (iii) DPA and PAN oligomers, some amount of a PAN monomer. Without wishing to be bound by any theory, the applicant thinks that the presence of a limited amount of PAN monomer, of at most 25% by weight, in combination with (i) DPA oligomers, (ii) PAN oligomers or (iii) DPA and PAN oligomers, would not alter the essential properties of the high temperature lubricating composition for conveyor chains.

In some embodiments, the stabilizing agent of the invention comprises less than 1% by weight of PAN, relative to the total weight of the hereabove defined (a)-(h) components. In some embodiments, said stabilizing additive comprises 0% by weight of PAN, relative to the total weight of the hereabove defined (a)-(h) components. In these latest embodiments, said additive does not contain any amount of PAN measurable by means of the hereabove mentioned chromatography methods.

In some embodiments, the additive comprises at least 2% by weight of oligomers in the form of dimers. In some embodiments, the additive comprises at most 30% by weight of oligomers in the form of dimers.

In some embodiments, the additive comprises at least 30% by weight of oligomers in the form of trimers. In some embodiments, the additive comprises at most 40% by weight of oligomers in the form of trimers.

In some embodiments, the additive comprises at least 10% by weight of oligomers in the form of tetramers. In some embodiments, the additive comprises at most 40% by weight of oligomers in the form of tetramers.

In some embodiments, the additive comprises at least 1% by weight of oligomers in the form of pentamers. In some embodiments, the additive comprises at most 20% by weight of oligomers in the form of pentamers.

In some embodiments, the additive comprises at least 1% by weight of oligomers in the form of hexamers. In some embodiments, the additive comprises at most 12% by weight of oligomers in the form of hexamers.

In some embodiments, the additive comprises less than 6% by weight of monomers of the PAN (II) and DPA (I) types and comprises a cumulated percentage of trimer and tetramer compounds of at least 45%. This type of embodiment is illustrated by Examples 1 and 4 of the present application.

Several embodiments that are representative of the monomer and oligomer qualitative and quantitative composition of the stabilizing agent for a high temperature lubricating composition to be used in conveyor chains are detailed hereunder.

In some particular embodiments, the additive used according to the present invention comprises a mixture of oligomers which qualitative and quantitative composition is as follows:

(a) from 0% to 3% by weight of diphenylamine of formula (I),
(b) from 0% to 3% by weight of phenyl-α-naphthylamine of formula (II),
(c) from 1% to 40% by weight of oligomers in the form of dimers,
(d) from 25% to 45% by weight of oligomers in the form of trimers,
(e) from 20% to 45% by weight of oligomers in the form of tetramers,
(f) from 1% to 25% by weight of oligomers in the form of pentamers,
(g) from 0% to 10% by weight of oligomers in the form of hexamers,
(h) from 0% to 10% by weight of oligomers in the form of heptamers or oligomers with a higher degree of polymerization, wherein the percentages by weight are expressed relative to the (a)-(h) components total weight.

Such an additive is illustrated in Examples 1 and 4 of the present application.

In some particular embodiments, the additive used according to the present invention comprises a mixture of oligomers which qualitative and quantitative composition is as follows:

(a) from 0% to 1% by weight of diphenylamine of formula (I),
(b) from 0% to 1% by weight of phenyl-α-naphthylamine of formula (II),
(c) from 1% to 5% by weight of oligomers in the form of dimers,
(d) from 30% to 45% by weight of oligomers in the form of trimers,
(e) from 20% to 35% by weight of oligomers in the form of tetramers,
(f) from 10% to 30% by weight of oligomers in the form of pentamers,
(g) from 0% to 15% by weight of oligomers in the form of hexamers,
(h) from 0% to 10% by weight of oligomers in the form of heptamers or oligomers with a higher degree of polymerization, wherein the percentages by weight are expressed relative to the total weight of (a)-(h) components.

In some other particular embodiments, the additive used according to the present invention comprises a mixture of oligomers which qualitative and quantitative composition is as follows:

(a) from 0% to 5% by weight of diphenylamine of formula (I),
(b) from 0% to 1% by weight of phenyl-α-naphthylamine of formula (II),
(c) from 40% to 95% by weight of oligomers in the form of dimers,
(d) from 0% to 15% by weight of oligomers in the form of trimers,
(e) from 0% to 1% by weight of oligomers in the form of tetramers,
(f) from 0% to 1% by weight of oligomers in the form of pentamers,
(g) from 0% to 1% by weight of oligomers in the form of hexamers,
(h) from 0% to 1% by weight of oligomers in the form of heptamers or oligomers with a higher degree of polymerization, wherein the percentages by weight are expressed relative to the total weight of components (a)-(h).

In still other particular embodiments, the additive used according to the present invention comprises a mixture of oligomers which qualitative and quantitative composition is as follows:

(a) from 15% to 30% by weight of diphenylamine of formula (I),
(b) from 0% to 1% by weight of phenyl-α-naphthylamine of formula (II),
(c) from 25% to 35% by weight of oligomers in the form of dimers,
(d) from 20% to 35% by weight of oligomers in the form of trimers,
(e) from 10% to 20% by weight of oligomers in the form of tetramers, (f) from 1% to 10% by weight of oligomers in the form of pentamers, (g) from 0% to 5% by weight of oligomers in the form of hexamers, (h) from 0% to 1% by weight of oligomers in the form of heptamers or oligomers with a higher degree of polymerization, wherein the percentages by weight are expressed relative to the (a)-(h) components total weight.

In still other particular embodiments, the additive used according to the present invention comprises a mixture of oligomers which qualitative and quantitative composition is as follows:

(a) from 0% to 1% by weight of diphenylamine of formula (I), (b) from 10% to 25% by weight of phenyl-α-naphthylamine of formula (II), (c) from 20% to 30% by weight of oligomers in the form of dimers, (d) from 20% to 30% by weight of oligomers in the form of trimers, (e) from 15% to 25% by weight of oligomers in the form of tetramers, (f) from 5% to 15% by weight of oligomers in the form of pentamers, (g) from 0% to 10% by weight of oligomers in the form of hexamers, (h) from 0% to 5% by weight of oligomers in the form of heptamers or oligomers with a higher degree of polymerization, wherein the percentages by weight are expressed relative to the total weight of the hereabove mentioned (a)-(h) components.

As illustrated in the examples, the advantageous properties of a stabilizing agent of the invention are improved in those embodiments of such additive wherein the ratio of oligomers to the monomer(s) is the highest.

On the other hand, also as illustrated in the examples, the advantageous properties of a stabilizing agent of the invention are improved in those embodiments wherein the highest amount of high sized oligomers can be found.

Thus, some preferred embodiments of an additive of the invention are those wherein the weight percentage ratio of oligomer(s) to monomer(s) is of at least 80, which includes additives wherein the weight percentage ratio of oligomer(s) to monomer(s) is of at least 85, 90, 91, 92, 93, 94, 95, 96, 97, 98 and 99.

Also, some preferred embodiments of the additive of the invention are those wherein the totality of oligomers in the form of trimer or in the form of oligomers having a a higher polymerization degree accounts for at least 70% by weight, relative to the total weight of the additive (a) to (h) components. The last preferred embodiments include additives wherein the totality of oligomers in the form of trimer or with a higher polymerization degree accounts for at least 75%, 80%, 85%, 90%, 91%, 92%, 93%, 94% or 95% by weight, relative to the total weight of the additive (a) to (h) components.

A "high amount of large-sized oligomers" may be illustrated through the average polymerization degree of the stabilizing additive. The average polymerization degree correlates with the average number of monomer unit comprised in the components of the additive. Such average polymerization degree can be calculated based on the sum of mole percentage of the additive components (that is to say of the oligomers and monomers that are contained in the additive), each mole percent being multiplied by the monomer unit average number comprised in the relevant component. The polymerization degree is obtained by dividing the sum obtained by 100.

For example, for an additive comprising 10% in moles of monomers, 60% in moles of dimers and 30% in moles of trimers (where the percentages are expressed in number of moles relative to the compound total number of moles (including monomers in a free form) forming the mixture of oligomers), the average polymerization degree will be: (10*1+60*2+30*3)/100 i.e. 2.2.

When the additive is obtained through an oligomerization reaction of one or more DPA and/or one or more PAN having similar molecular weights, an estimation of the average polymerization degree may be obtained by replacing the mole percentages by the corresponding weight percentages.

It is obvious that when the additive is obtained through the oligomerization reaction of a single compound, the polymerization degree may be obtained indifferently from the mole percentages or the weight percentages.

Particularly preferred stabilizing agents of the invention comprise a mixture of oligomers with an average polymerization degree of at least higher than about 2.

At least higher than about 2 includes 2, 3, 3.5, 4, 4.5, 5, 6, 7, 8, 9. Preferably, the average polymerization degree of the stabilizing agent of the invention does range from about 2 to about 6, preferably from about 2.5 to about 5.

Furthermore it may be emphasized that the preferred additives of the invention, which comprise a high amount of large-sized DPA and PAN oligomers, surprisingly induce a decomposition rate of the lubricant to which they are added, that is similar to the decomposition rate of additives comprising a lesser amount of large-sized oligomers. It may further be emphasized that the preferred additives of the invention, which comprise a high amount of large-sized DPA and PAN oligomers, surprisingly induce a decomposition rate of the lubricant to which they are added, that is similar to the decomposition rate of comparative lubricants not containing those additives, including lubricants exclusively comprising aromatic amine monomers.

In a general manner, for preparing a stabilizing agent of a high temperature lubricating composition for a conveyor chain, a method is carried out, which comprises following steps consisting in:

a) making react aromatic amines selected from:

(i) one or more diphenylamine (DPA) compounds of formula (I) below:

(I)

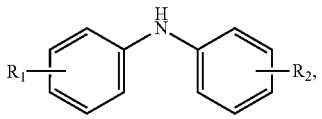

wherein the groups $R_1$ and $R_2$ stand for, independently of one another, a hydrogen or a linear or branched alkyl group having from 1 to 30 carbon atoms, advantageously from 4 to 12 carbon atoms, (ii) one or more phenyl-α-naphthylamine (PAN) compounds of formula (II) below:

(II)

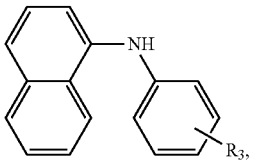

wherein the group $R_3$ stands for a hydrogen or a linear or branched alkyl group having from 1 to 30 carbon atoms, advantageously from 4 to 12 carbon atoms, and (iii) (DPA) compounds of formula (I) above with (PAN) compounds of formula (II) above, in the presence of a catalyst and in a solvent and at a temperature ranging from 85° C. to 150° C.;

b) cooling the reaction mixture at a temperature of at most 80° C.;

c) filtering the reaction mixture cooled down in step b).

Advantageously, when a stabilizing additive of the invention is prepared by making DPA compounds react, one may make reacting up to three distinct DPA compounds of formula (I) with each other, and advantageously two distinct DPA compounds of formula (I). Preferably, said stabilizing additives are the products resulting from the reaction of molecules of a single DPA compound of formula (I) with each other.

Advantageously, when a stabilizing additive of the invention is produced by making PAN compounds react, one may make reacting up to three (PAN) compounds of formula (II) with each other, and advantageously two distinct (PAN) compounds of formula (II). Preferably, said stabilizing additives are the products resulting from the reaction of molecules of a single (PAN) compound of formula (II) with each other.

Preferably, when a stabilizing additive of the invention is produced by making a (DPA) compound of formula (I) react with a (PAN) compound of formula (II), the (DPA) and (PAN) compounds are reacted in a molar ratio of compound (I) to compound (II) ranging from 1:2 to 10:1. in the presence of a catalyst and in a solvent and at a temperature ranging from 85° C. to 150° C.

By varying the molar ratio of compound (I) to compound (II), it is possible to control, among other things, the presence of DPA or PAN monomer in the final oligomer composition as is well known from the person skilled in the art. The absence or the presence of the desired amount of DPA or PAN monomer is controlled by varying the duration of step a).

To be used as a catalyst is alkyl peroxide or potassium permanganate.

As an alkyl peroxide-based catalyst, tert-butyl peroxide or di-tert-butyl peroxide are preferably used.

However, a potassium permanganate-based catalyst is most preferably used.

Preferred embodiments for preparing stabilizing additives of the invention are described hereafter by referring to examples for making a stabilizing additive consisting in a product of the reaction of a (DPA) compound of formula (I) with a (PAN) compound of formula (II). In view of the description of those preferred embodiments, the person skilled in the art is able to adapt the conditions described for preparing the other stabilizing additives of the invention, by means of simple routine assays, based on the description of said examples.

Preferably, in step a), the reaction mixture comprises the DPA compound, the PAN compound and potassium permanganate dissolved in an organic solvent adapted to the reaction temperature. Solvents that can be suitably used include solvents based on aliphatic hydrocarbon compounds, including alkanes with from 6 to 16 carbon atoms in a linear, a branched or a cyclic structure. A petroleum solvent of the Exxsol DSP 100/140 solvent type marketed by the company ExxonMobil Chemical may be used for example.

The weight ratio [PAN+DPA+catalyst reactants]/[solvent,] is advantageously of about 1.

Preferably, at least step a) of the method is carried out in the presence of an inert gas atmosphere highly depleted in oxygen so as to avoid any unwanted oxidation reaction. Classically, step a) is carried out in a reactor under a nitrogen or an argon atmosphere.

In step a), the temperature of the reaction is advantageously of at most 100° C. In addition, the temperature of the reaction is advantageously of at least 30° C.

Advantageously, step a) is a step that is carried out under reflux conditions.

Advantageously, in step a), compounds of formula (I) and compounds of formula (II) are first added to the solvent, thereafter following a pre-heating step, a catalyst is added thereto, for example potassium permanganate, so as to initiate the actual condensation reaction. Said pre-heating period is carried out during all the time necessary to bring the initial reaction mixture, free of catalyst, to the expected reaction temperature. The pre-heating period duration may range from 1 minute to 1 hour, depending on the chosen reaction conditions, in particular especially depending on the installation and on the volume of the initial reaction mixture.

For obtaining optimal reaction conditions, step a) may comprise following sub-steps:

a1) providing a reactor filled with the suitable volume of the selected solvent;

a2) adding the suitable amounts of each of the DPA compounds of formula (I) and PAN compounds of formula (II);

a3) optionally, placing the reactor under an oxygen-depleted atmosphere, for example through nitrogen or argon injection;

a4) performing a pre-heating of the reaction medium obtained at the end of step a2) or step a3) at a temperature ranging from 55° C. to 85° C., preferably from 60° C. to 80° C.;

a5) adding a suitable amount of the catalyst to the reaction mixture obtained at the end of step a4);

a6) increasing the reaction mixture temperature until the selected reaction temperature has been reached;

a7) maintaining the reaction medium at the selected reaction temperature, for the time required for obtaining the expected final amount of monomer(s) and oligomers.

The order of steps a3) to a5) above, or as an alternative of steps a4) and a5) above, makes no difference, even if optimal reaction conditions could be observed when the initial order from a1) to a7) had been observed.

Most preferably, the reaction medium is maintained in step a), and more particularly in step a7), at a temperature ranging from 125° C. to 150° C.

In step a7) the oxidative condensation reaction is initiated and it is important to strictly regulate the temperature value of the reaction medium, because it is an exothermic reaction.

Duration of step a) is advantageously of at least 5 hours and is typically of at least 10 hours. Duration of step a) is typically of at most 30 hours, and is typically of at most 20 hours, depending on the chosen reaction conditions, especially the selected temperature conditions. In a general manner, duration of step a) depends on duration of step a7), which is the step during which the actual condensation reaction occurs.

In step b) of the method, the reaction mixture is cooled down to a temperature of at most 80° C., for example by simply turning off the heating means.

In step c), the reaction mixture is filtered to remove possible deposits which were generated during the previous steps. A fine filtration is advantageously performed so as to reduce the deposit content to a maximum amount of 1 mg per liter of reaction mixture, for example in compliance with the FTM-S-791-3010 standard-Federal Test Method defined by the American government.

In some embodiments of step c), the actual filtration may be followed with a washing of the reaction medium using an aqueous solution, typically demineralized water, so as to remove from the solvent the possible residual impurities. Thereafter the aqueous solution is removed, for example through a simple drawing off, prior to carrying out desolvation step d).

In some embodiments, the stabilizing agent of the invention may come as a powder.

For preparing the stabilizing agent of the invention in a powdered form, the hereabove described method comprises the following additional step:

d) removing the residual solvent to obtain the antioxidizing agent and/or anti-corrosion agent in a powdered form.

In step d), the residual solvent may be removed according to any known desolvation method, including desolvation through vacuum heating, where the operating conditions have to be adapted depending on the solvent type used. For example, desolvation under vacuum may be carried out at a temperature ranging from 140° C. to 300° C., advantageously from 150° C. to 270° C. If needed, the solvent removal may be completed by flushing the reaction product with an inert gas, for example nitrogen or argon.

Preferably, the solvent content of the reaction product obtained at the end of step d) is adjusted to a value of less than 50 mg of solvent per kg of the final reaction product.

In the method of the invention, using a molar ratio of compound (I) to compound (II) ranging from ½ to 10:1 makes it especially possible to adjust the amount of unreacted DPA monomer found in the end product of the method, that is to say the stabilizing agent of the invention.

According to an advantageous characteristic, when the catalyst is potassium permanganate, a molar ratio of potassium permanganate to [compound (I)+compound (II)] of at least 0.25/1 and of at most 0.75/1 is used in step a). The molar ratio of potassium permanganate to [compound (I)+compound (II)] is preferably of at least 0.30/1. The molar ratio of potassium permanganate to [compound (I)+compound (II)] is preferably of at most 0.70/1.

Selecting an optimal molar ratio between permanganate and DPA and PAN starting products is important to obtain an end product having the desired qualitative and quantitative composition as regards monomer(s) and oligomers. At the end of step d) of the method, a stabilizing agent of the invention is obtained, in the form of a powder.

The stabilizing agent of the invention may be used for preparing an additive composition as a liquid intended to be added to a lubricating composition, in order to obtain a lubricating composition for a conveyor chain that can withstand high temperatures.

According to a first embodiment for making a liquid stabilizing composition from a stabilizing agent of the invention, a suitable amount of stabilizing agent is added as a powder, obtained at the end of step d) of the method above, to a suitable amount of an appropriate oil, for example a synthetic ester-based oil.

According to a second embodiment for making a liquid stabilizing composition from a stabilizing agent of the invention, said stabilizing composition is prepared according to a method comprising the steps a) to c) of the method described above, said method further comprising the following additional steps:

d) preparing a mixture of (i) the filtered reaction medium obtained at the end of step c) and (ii) a suitable amount of an appropriate oil, preferably a synthetic ester-based oil;

e) removing the solvent, in order to obtain a stabilizing composition as a liquid.

In a liquid stabilizing composition of the invention, whatever the preparation method thereof, the stabilizing agent is present in the oil-based liquid in an amount ranging from 10% to 60% by weight of the powdered stabilizing agent, and preferably in an amount ranging from 20% to 50% by weight, relative to the liquid stabilizing composition total weight. Most preferably, the amount of stabilizing agent is ranging from 25% to 35% by weight, relative to the liquid stabilizing composition total weight.

As already noted, the stabilizing agent of the invention, or as an alternative a stabilizing composition such as defined above, is generally intended to be used as an additive for making lubricating compositions for conveyor chains withstanding high temperatures.

As illustrated in the examples, the stabilizing agent of the invention provides a broad variety of basic lubricating compositions for conveyor chains with improved stability properties to resist to high temperatures. Thus, the stabilizing agent of the invention is well adapted to stabilize starting lubricating compositions as varied as polyol ester-based oils, alcohol trimellitate-based oils, polyester-based oils and mineral oils. In some embodiments, the lubricating composition is selected from a mineral oil and a synthetic ester-based oil.

Indeed, the results in the examples also show that the stabilizing agent of the invention is suitable for stabilizing a plurality of various polyol ester-based oils, in particular of oils comprising esters having highly varied chain lengths and therefore possessing distinct initial viscosity characteristics.

By adding the stabilizing additive, previously described in detail, to a starting lubricating composition, a stabilized and thermally resistant lubricating composition is obtained, for the lubrication of a conveyor chain subjected to a temperature of at least 120° C.

As illustrated in the examples, a lubricating composition comprising a suitable amount of a stabilizing additive of the invention is able to retain its lubricating power until more than thousand hours of a continuous exposure at a temperature of 200° C.

As a comparison, a similar lubricating composition not containing the stabilizing additive of the invention, for example a similar lubricating composition comprising aromatic amine monomers, does decompose and lose its lubricating properties after less than 600 hours of a continuous exposure at a temperature of 200° C.

In a thermally stabilized lubricating composition for a conveyor chain according to the invention, the stabilizing agent content is always expressed as the stabilizing agent final content per se, and not as the content of the stabilizing composition itself comprising said stabilizing agent. As an example, a thermally stabilized lubricating composition for a conveyor chain comprising 2.5% by weight of the stabilizing agent may be obtained (i) by directly adding the suitable amount of the stabilizing agent to the lubricating composition (for example 2.5 g of stabilizing agent added to 97.5 g of lubricating composition), or (ii) by adding the suitable amount of stabilizing composition comprising said stabilizing agent to the lubricating composition (for example 25 g of a stabilizing composition at 10% by weight of stabilizing agent added to 75 g of lubricating composition).

As illustrated in the examples, a lubricating composition for a conveyor chain comprising a stabilizing additive such as defined in the present specification, or that may be obtained according to the method described above, has a significantly improved thermal stability, as compared to the same lubricating composition free of said additive or as compared to the same lubricating composition free of said additive but comprising a mixture of aromatic amine monomers.

In addition, a lubricating composition for a conveyor chain that has been thermally stabilized by adding an additive of the invention rapidly decomposes generating only a small amount of residual compounds, typically an amount of residual compounds lower than 50% by weight, relative to the total weight of the stabilized starting lubricating composition. The amount of residual compounds is generally lower than 30% by weight relative to the total weight of the stabilized starting lubricating composition, when the stabilizing additive of the invention is used for preparing a suitable basic lubricating composition, and particularly for preparing a lubricating composition with a polyol ester-based oil.

Advantageously, a thermally stabilized lubricating composition for a conveyor chain of the invention comprises an amount of stabilizing agent such as defined above ranging from 0.1% to 10% by weight of the stabilizing agent as a powder, relative to said lubricating composition total weight. In embodiments wherein the stabilizing agent added to the lubricating composition comes as a liquid as previously described, the stabilizing agent content in the lubricating composition is calculated based on the initial powder amount of said stabilizing agent.

Preferably, a thermally stabilized lubricating composition for a conveyor chain of the invention comprises an amount of stabilizing agent ranging from 0.5% to 5% by weight, and most preferably ranging from 1% to 4% by weight, relative to said lubricating composition total weight.

Generally, the stabilizing agent may be added to various types of industrial oils, preferably oils appropriate to conveyor system chains.

In some embodiments of lubricating compositions of the invention, the stabilizing agent is added to lubricating oils composed of synthetic esters that are well known from the person skilled in the art.

For example, one may use lubricating oils may be used for example based on esters produced from mono-hydroxylated alcohols and mono-carboxylic acids, or from mono-hydroxylated alcohols and dicarboxylic acids. Such esters are well known from the person skilled in the art. They are described for example in the American patent no U.S. Pat. No. 3,432,433. Alcohols and acids used for preparing esters may comprise from one to six functional groups, making thus possible the synthesis of mono-, di-, tri- and tetra-, penta- and hexa-esters. Included are alcohol esters, diols, triols and pentaerythritols, said alcohols or polyols having from 2 to 20 carbon atoms, and said mono- and di-carboxylic acids having from 2 to 20 carbon atoms, preferably from 4 to 12 carbon atoms. Polyols include trimethylolpropane, pentaerythritol, dipentaeryhthritol, neopentylglycol, tripentaerythritol, di-TMP and combinations thereof.

Esters that might be contained in a lubricating composition of the invention include monoesters resulting from the reaction of linear or branched carboxylic monoacids with a chain length of from 2 to 24 carbon atoms, as for example octylacetate, decylacetate, octadecylacetate, caprylate/caproate ethyl 2 hexyl, methyl myristate, butyl stearate, methyl oleate monoesters, as well as dibutyl phthalate, di-octyl adipate, di-2-ethylhexyl azelate and ethylhexyl sebacate polyesters, polyesters resulting from the reaction of polyols with linear and/or branched carboxylic monoacids having from 2 to 24 carbon atoms and from carboxylic polyacids having from 2 to 40 carbon atoms, or polyesters resulting from the reaction of carboxylic polyacids having from 2 to 40 carbon atoms with monoalcohols of from 1 to 24 carbon atoms and polyols. The basic oil of the polyol ester type may be an oil prepared from dipentaerythritol or technical pentaerythritol or trimethylol propane and from a combination of linear and/or branched carboxylic acids of from 4 to 24 carbon atoms. Technical pentaerythritol is a mixture which comprises from about 85% to 92% by weight of monopentaerythritol and from 8% to 15% by weight of dipentaerythritol.

A classically marketed technical pentaerythritol contains about 88% by weight of monopentaerythritol and about 12% by weight of dipentaerythritol, relative to the total weight of said ester type basic oil. Technical pentaerythritol may further contain some amount of tri- and tetra-pentaerythritol which are usually formed as by-products during the production of technical pentaerythritol.

As illustrated in the examples, the stabilizing agent of the invention may also be added for thermally stabilizing alcohol trimellitate-based oils.

In a lubricating composition of the invention, the stabilizing agent may be used in combination with other additives, such as detergents, antifoams, anticorrosion agents, rust-preventing agents, anti-wear agents, additives suitable for extremely high pressures, stabilizers against hydrolysis, fillers or even viscosity modifiers, such additives being well known from the person skilled in the art and commonly commercially available.

The present invention further relates to a method for lubrifying a conveyor chain comprising a step consisting in applying onto a conveyor chain a high temperature lubricating composition such as defined above.

The present invention will be now further illustrated by means of the hereunder following examples.

EXAMPLES

Hereafter, OPAN is intended to mean N-(para-tertio-octylphenyl)-α-naphthylamine, DODPA is intended to mean di-octyl phenylamine and PAN is intended to mean phenyl-α-naphthylamine.

Example 1

Preparing a Stabilized Lubricating Composition for a Conveyor Chain

A. Protocol for Preparing a Heat Stabilizing Agent for a Conveyor Chain

In a Pyrex fat flask, fitted with a stirring bar in stainless steel, a thermal jacket, a nitrogen bubbler, a Dean Stark and a cooler, load:

50 g. OPAN,
50 g. DODPA,
116 g. SOLVENT (EXXSOL D 30).

1) The reaction proceeds under inert atmosphere (nitrogen).
2) Heat and stir (the temperature raise should be controlled).
3) At a temperature of about 60° C., add 29.3 g. of $KMnO_4$ at one time.

4) Gradually increase the temperature between 100° C. and 200° C.
5) Maintain these conditions, until the monomer has completely disappeared.
6) At the end of the reaction, make the reaction mixture pass through a folded filter and then through a 1.2 μm membrane filter, until a deposit content of less than 2 mg/l is obtained. The K and Mn content is then nil.
7) The solvent is removed under vacuum and by heating: depending on the final chosen form—solid or liquid (diluted) and depending on the material used, the final temperature of desolvation may vary (example: diluted 250° C. finally under 2 to 3 mmHg).
8) Measure the solvent residual content which should be nil.

B. Analyzing the Qualitative and Quantitative Composition of the Stabilizing Agent B.1.) An analysis is carried out through a supercritical chromatography, according to the following protocol:
prepare a 20% DODPA standard solution:
80% of copolymer without DODPA monomer and 20% of DODPA diluted ×100 in heptane are prepared, then 5 μl are injected in supercritical-fluid chromatography (SFC).
prepare a solution of the reaction mixture to dose:
a sample of the reaction medium is collected upon oxidation at ~50% in EXXSOL D 30 diluted 50× in ethyl acetate and 5 μl are injected in supercritical-fluid chromatography (SFC).
dose free DODPA in Ultra Violet at 268 nm:
DODPA peak areas are compared in both cases:
% DODPA: DODPA peak area to dose×20/DODPA standard peak area.

B.2) The results of the chromatographic analysis are given in Table 1 hereunder.

TABLE 1

Qualitative and quantitative composition of the stabilizing agent

| Component type | % by weight* |
|---|---|
| DODPA monomer | <1.0 |
| OPAN monomer | <1.0 |
| Dimers | 2.2 |
| Trimers | 36.6 |
| Tetramers | 26.5 |
| Pentamers | 19.3 |
| Hexamers | 10.0 |
| Heptamers and higher | 3.4 |

Average polymerization degree(**): 4.02

*Weight percentage relative to the antioxidant total weight.

(**)The average polymerization degree is calculated in Examples as being the sum of the weight percentages of each compound multiplied by the number of monomers present in each compound, the sum being divided by 100. This calculation is based on the approximation according which DODPA molar weight is very closed to that of OPAN. As an illustration, a mixture comprising 40% of dimers and 60% of trimers has an average polymerization degree equal to: (40 * 2 + 60 * 3)/100 = 2.6

C. Preparing a Lubricating Composition for a Conveyor Chain Comprising the Stabilizing Additive 1) In a beaker, weigh the required amount of ester and additives including the one that is the object of the invention.

| COMPOSITION | (weight %) |
|---|---|
| Ester | ~95 |
| OAA 1 | ~3 |
| Other additives | ~2 |

2) Heat under stirring, up to 110° C. and until complete dissolution of the additives is achieved.
3) Filter.

Example 2

Preparing a Stabilized Lubricating Composition for a Conveyor Chain

A. Preparing a Stabilizing Agent

A.1) In a Pyrex fat flask, fitted with a stirring bar in stainless steel, with a thermal jacket, a nitrogen bubbler, a Dean Stark and a cooler, load:
100 g. DODPA,
116 g. SOLVENT (EXXSOL DSP 100/140).

A.2) The reaction proceeds under inert atmosphere (nitrogen).

A.3) Heat and stir (the temperature raise should be controlled).

A.4) At a temperature of about 70° C., add 14.6 g. of $KMnO_4$ at one time.

A.5) Gradually, increase the temperature between 100 and 200° C.

A.6) Maintain these conditions, until a monomer residual content lower than 5% is obtained.

A.7) At the end of the reaction, make the reaction mixture pass through a folded filter and then through a 1.2 μm membrane filter, until a deposit content of less than 2 mg/l is obtained. The K and Mn content is then nil.

A.8) The solvent is removed under vacuum and by heating: depending on the final chosen form—solid or liquid (diluted) and depending on the material used, desolvation final temperature may vary (example: for dilution at 150-160° C. in final under 2-3 mmHg).

A.9) Measure the solvent residual content. The said solvent residual content should be nil.

B. Analyzing the Qualitative and Quantitative Composition of the Stabilizing Agent B.1.) An analysis is carried out through a supercritical chromatography, according to the following protocol:
prepare a 20% DODPA standard solution:
80% of copolymer without DODPA monomer and 20% of DODPA diluted ×100 in heptane are prepared, then 5 μl are injected in supercritical-fluid chromatography (SFC).
prepare a solution of the reaction mixture to dose:
a sample of the reaction medium is collected upon oxidation at ~50% in EXXSOL DSP 100/140 diluted 50× in ethyl acetate and 5 μl are injected in supercritical-fluid chromatography (SFC).
dose free DODPA in Ultra Violet at 268 nm:
DODPA peak areas are compared in both cases:
% DODPA: DODPA peak area to dose*20/DODPA standard peak area.
The results are illustrated on the chromatogram.

B.2) The results of the chromatographic analysis are given in Table 2 hereunder.

TABLE 2

Qualitative and quantitative composition of the stabilizing agent

| Component type | % by weight* |
|---|---|
| DODPA monomer | 3.0 |
| Dimers | 90.7 |
| Trimers | 4.3 |
| Tetramers | <1 |
| Pentamers | <1 |

Average polymerization degree(**): 2.06

*Percentage by weight relative to the stabilizing agent total weight.

(**)See example 1

C. Preparing a Lubricating Composition for a Conveyor Chain Comprising the Stabilizing Additive 1) In a beaker, weigh the required amount of ester and additives including the one that is the object of the invention.

| COMPOSITION | (weight %) |
|---|---|
| Ester | ~95 |
| Additive of the invention | ~3 |
| Other additives | ~2 |

2) Heat under stirring, up to 110° C. and until complete dissolution of the additives is achieved.

3) Filter.

Example 3

Preparing a Stabilized Lubricating Composition for a Conveyor Chain

A. Preparing a Stabilizing Agent

A.1) In a Pyrex fat flask, fitted with a stirring bar in stainless steel, with a thermal jacket, a nitrogen bubbler, a Dean Stark and a cooler, load:

20 g. OPAN, 80 g. DODPA, 117 g. SOLVENT (EXXSOL DSP 100/140).

A.2) The reaction proceeds under inert atmosphere (nitrogen).

A.3) Heat and stir (the temperature raise should be controlled).

A.4) At a temperature of about 70° C., add 14.6 g. of $KMnO_4$ at one time.

A.5) Gradually increase the temperature between 100 and 200° C.

A.6) Maintain these conditions, until a DODPA residual content of about 20% is obtained.

A.7) At the end of the reaction, make the reaction mixture pass through a folded filter and then through a 1.2 μm membrane filter, until a deposit content of less than 2 mg/l is obtained. The K and Mn content is then nil.

A.8) The solvent is removed under vacuum and by heating: depending on the final chosen form—solid or liquid (diluted) and on the material used, desolvation final temperature may vary (example: for dilution at 150-160° C. in final under 2-3 mmHg).

A.9) Measure the solvent residual content. The said solvent residual content should be nil.

B. Analyzing the Qualitative and Quantitative Composition of the Stabilizing Agent B.1) An analysis is carried out through a supercritical chromatography, according to the following protocol:

prepare a 20% DODPA standard solution:

80% of copolymer without DODPA monomer and 20% of DODPA diluted ×100 in heptane are prepared, then 5 μl are injected in supercritical-fluid chromatography (SFC).

prepare a solution of the reaction mixture to dose:

a sample of the reaction medium is collected upon oxidation at ~50% in DSP 100/140 diluted 50× in ethyl acetate and 5 μl are injected in supercritical-fluid chromatography (SFC).

dosage of free DODPA in Ultra Violet at 268 nm:

DODPA peak areas are compared in both cases:

% DODPA: DODPA peak area to dose*20/DODPA standard peak area.

The results are illustrated on the chromatogram.

B.2) The results of the chromatographic analysis are given in Table 3 hereunder.

TABLE 3

Qualitative and quantitative composition of the stabilizing agent

| Component type | % by weight* |
|---|---|
| DODPA monomer | 23.1 |
| OPAN monomer | N.D.(**) |
| Dimers | 30.6 |
| Trimers | 29.2 |
| Tetramers | 12.4 |
| Pentamers | 4.7 |

Average polymerization degree: 2.45(***)

*Percentage by weight relative to the stabilizing agent total weight..

(**)Not Detectable.

(***)See example 1

C. Preparing a Lubricating Composition for a Conveyor Chain Comprising the Stabilizing Additive 1) In a beaker, weigh the required amount of ester and additives including the one that is an object of the invention.

| COMPOSITION | (weight %) |
|---|---|
| Ester | 94.61 |
| Additive of the invention | 2.50 |
| Other additives | 2.89 |

2) Heat under stirring, up to 110° C. and until complete dissolution of the additives is achieved.

3) Filter.

Example 4

Preparing a Stabilized Lubricating Composition for a Conveyor Chain

A. Preparing a Stabilizing Agent

A.1) In a Pyrex fat flask, fitted with a stirring bar in stainless steel, with a thermal jacket, a nitrogen bubbler, a Dean Stark and a cooler, load:

100 g. OPAN, 116 g. SOLVENT (EXXSOL DSP 100/140).

A.2) The reaction proceeds under inert atmosphere (nitrogen).

A.3) Heat and stir (the temperature raise should be controlled).

A.4) At a temperature of about 70° C., add 14.6 g. of $KMnO_4$ at one time.

A.5) Gradually increase the temperature between 100 and 200° C.

A.6) Maintain these conditions, until a monomer residual content of about 20% is obtained.

A.7) At the end of the reaction, make the reaction mixture pass through a folded filter and then through a 1.2 μm membrane filter, until a deposit content of less than 2 mg/l is obtained. The K and Mn content is then nil.

A.8) The solvent is removed under vacuum and by heating: depending on the final chosen form—solid or liquid (diluted) and on the material used, desolvation final temperature may vary (example: for dilution at 150-160° C. in final under 2-3 mmHg).

A.9) Measure the solvent residual content. The said content should be nil.

B. Analyzing the Qualitative and Quantitative Composition of the Stabilizing Agent B.1.) An analysis is carried out through a supercritical chromatography, without internal standard. The composition of the additive is deduced from the peak areas of the obtained chromatogram.

B.2) The results of the chromatographic analysis are given in Table 4 hereunder.

TABLE 4

Qualitative and quantitative composition of the stabilizing agent

| Component type | % by weight* |
|---|---|
| OPAN monomer | 17 |
| Dimers | 24.7 |
| Trimers | 24.4 |
| Tetramers | 17.2 |
| Pentamers | 11.7 |
| Hexamers | 5.0 |
| Average polymerization degree(**) | 2.97 |

*Percentage by weight relative to the stabilizing agent total weight . . .
(**)See example 1

C. Preparing a Lubricating Composition for a Conveyor Chain Comprising the Stabilizing Additive C.1) In a beaker, weigh the required amount of ester and additives including the one that is an object of the invention.

| COMPOSITION | (weight %) |
|---|---|
| Ester | ~95 |
| Additive of the invention | ~3 |
| Other additives | ~2 |

C.2) Heat under stirring, up to 110° C. and until complete dissolution of the additives is achieved.

C.3) Filter.

Example 5

Preparing a Stabilized Lubricating Composition for a Conveyor Chain

A. Preparing a Stabilizing Agent

A.1) In a Pyrex fat flask, fitted with a stirring bar in stainless steel, with a thermal jacket, a nitrogen bubbler, a Dean Stark and a cooler, load:
100 g. DODPA
6g PAN
116 g. SOLVENT (EXXSOL D30).

A.2) The reaction proceeds under inert atmosphere (nitrogen).

A.3) Heat and stir (the temperature raise should be controlled).

A.4) At a temperature of about 70° C., add 27.1 g. of $KMnO_4$ at one time.

A.5) Gradually increase the temperature between 100 and 200° C.

A.6) Maintain these conditions, until the monomer has disappeared (<2%)

A.7) At the end of the reaction, make the reaction mixture pass through a folded filter and then through a 1.2 μm membrane filter, until a deposit content of less than 2 mg/l is obtained. The K and Mn content is then nil.

A.8) The solvent is removed under vacuum and by heating: depending on the final chosen form—solid or liquid (diluted) and on the material used, the final temperature of desolvation may vary (example: for dilution at 250° C. in final under 2-3 mmHg).

A.9) Measure the solvent residual content (should be nil).

B. Analyzing the Qualitative and Quantitative Composition of the Stabilizing Agent B.1.) An analysis was carried out through a supercritical chromatography, according to the following protocol:
prepare a 20% DODPA standard solution:
80% of copolymer without DODPA monomer and 20% of DODPA diluted ×100 in heptane are prepared, then 5 μl are injected in supercritical-fluid chromatography (SFC).
prepare a solution of the reaction mixture to dose:
a sample of the reaction medium is collected upon oxidation at ~50% in EXXSOL DSP 100/140 diluted 50× in ethyl acetate and 5 μl are injected in supercritical-fluid chromatography (SFC).
dose free DODPA in Ultra Violet at 268 nm:
DODPA peak areas are compared in both cases:
% DODPA: DODPA peak area to dose*20/DODPA standard peak area.
The results are illustrated on the chromatogram.

B.2) The results of the chromatographic analysis are given in Table 5 hereunder.

TABLE 5

Qualitative and quantitative composition of the stabilizing agent

| Component type | % by weight* |
|---|---|
| DODPA monomer | <1 |
| PAN monomer | N.D. |
| Dimers | 28.2 |
| Trimers | 33.0 |
| Tetramers | 35.9 |
| Pentamers | 1.9 |

Average polymerization degree(**): 3.1
*Percentage by weight relative to the stabilizing agent total weight.
(**)See example 1 - It should be noted that the PAN initial amount is very low as compared to the DODPA initial amount.

C. Preparing a Lubricating Composition for a Conveyor Chain Comprising the Stabilizing Additive C.1) In a beaker, weigh the required amount of ester and additives including the one that is an object of the invention.

| COMPOSITION | (weight %) |
|---|---|
| Ester | ~95 |
| Additive of the invention | ~3 |
| Other additives | ~2 |

C.2) Heat under stirring, up to 110° C. and until complete dissolution of the additives is achieved.

C.3) Filter.

Example 6

Comparative Tests for Thermally Stabilizing a First Polyol Ester-based Oil

A. Production Protocols a) Formulation 1: 179-50-F6

Neopolyol ester 3, viscosity at 40° C.=370 $mm^2/s$, with 3% by weight of oligomer from synthesis 1 and 2% by weight of an anti-wear additive 1.

b) Formulation 2: 170-46-F1

Neopolyol ester 3, viscosity at 40° C.=370 $mm^2/s$, with 3% of oligomer from synthesis 3 and 2% by weight of an anti-wear additive 1.

c) Formulation 3:

Neopolyol ester 3, viscosity at 40° C.=370 $mm^2/s$, with 3% of oligomer from synthesis 2 and 2% by weight of an anti-wear additive 1.

d) Formulation 4: 179-50-F3

Neopolyol ester 3, viscosity at 40° C.=370 $mm^2/s$, with 3% of oligomer from synthesis 5 and 2% by weight of an anti-wear additive 1.

e) Formulation 5 (Comparative):170-46-F2

Neopolyol ester 3, viscosity at 40° C.=370 $mm^2/s$, with 3% of a mixture of reference alkylated aromatic amine, 1.5% of pp'dioctyl diphenyl amine (Irganox LO1 from Ciba Geigy)+ 1.5% of octyl phenyl alpha naphthylamine (Irganox LO6 from Ciba Geigy) and 2% by weight of an anti-wear additive 1.

f) Cup Assay and Interpretation of the Results

The assay used for studying the performances of the prepared formulations is the so called "cup assay". This assay is widely used for comparing and predicting in laboratory the performance of lubricating compositions for conveyor chains.

In this assay, a given amount of oil is distributed in an aluminium cup so as to form a few-millimeter thin layer. The cup is placed in a temperature-controlled oven at a given constant temperature, usually selected from 200 to 250° C. In the context of the following examples, assays were conducted at 200° C. for a lubricating formulation amount of 10+/−0.1 g.

At regular time intervals, the cup is weighed for determining the weight loss resulting from the lubricant degradation. The appearance of the fluid should also be taken into account, that is to say the viscosity thereof.

A particularly important criterion is the time required for obtaining a gel (liquid cannot flow anymore) in the cup.

For each assay performed, the residual weight percentage is reported as a function of time. The residual weight percentage illustrates the degree of evaporation of the tested lubricating composition over time.

The curve obtained may, for some lubricating formulations (such as those of the present example), have the following profile:

- a phase 1 during which the residual weight percentage is close to 100% or is slowly decreasing: a plateau can therefore be observed;
- a phase 2 during which the residual percentage falls more rapidly
- a phase 3 which corresponds to a final plateau Phase 2 corresponds generally to the gelling phenomenon.

Amongst the lubricating formulations having such a profile, the lubricating formulations that are the most adapted to conveyor chains are those having generally a high thermal resistance capacity. A high thermal resistance capacity is generally correlated to a long-lasting phase 1.

It should be noted that when the degradation or gelling phenomenon occurs, this one occurs advantageously as soon as possible. Such a characteristic is illustrated through a very short phase 2.

When the degradation or the gelling of the lubricating formulation occurs, it is also desirable that the residual mass final percentage be low, which, from a practical point of view, enables to reduce the cleaning frequency of the conveyor chains.

B. Test Results

Test results are illustrated on FIG. 1.

B.1. Service Life

The results of FIG. 1 show that all the formulations of lubricating compositions comprising a stabilizing additive based on DPA and PAN oligomers (formulations no 1, 2, 3 and 4) have a significantly improved high temperature resistance capacity, as compared to the comparative formulation 5 which does not contain such additive.

It could be observed that formulation no 2, which shows the lesser improvement has a capacity to maintain its high temperature-resistance properties over time of about 20% higher than the comparative formulation which does not contain the DPA and PAN oligomer-based additive (720 hours versus 600 hours for comparative formulation no 5).

It could also be observed that formulations no 1 & 4 have a capacity to maintain their high temperature-resistance properties for a time period that is three times longer than that of the comparative formulation no 5 (1850 hours versus 600 for comparative formulation no 5).

It should be noted that comparative formulation no 5 comprises 3% by weight of a mixture of alkylated aromatic amines, more precisely a mixture of OPAN and DODPA monomers.

B.2. Decomposition

The results of FIG. 1 show that all the formulations of the invention (formulations no 1, 2, 3 and 4) are able to decompose rapidly.

In addition, it could be observed that the degradation rate of the formulations of the invention (formulations no 1, 2, 3 and 4) is comparable to or even the same as the degradation rate of the comparative formulation no 5.

Also, the decomposition of the formulations of the invention (formulations no 1, 2, 3 and 4) causes the formation of a small amount of residues.

Example 7

Comparative Tests for Thermally Stabilizing a Second Polyol Ester-based Oil

A. Preparation Protocols a) Formulation 6: 175-41-F6

Neopolyol ester 2, viscosity at 40° C.=250 $mm^2/s$, with 3% by weight of oligomer from synthesis 1 and 2% by weight of an anti-wear additive 2 and 0.05% of an anti-corrosion additive 1.

b) Formulation 7: 170-46-F6

Neopolyol ester 2, viscosity at 40° C.=250 $mm^2/s$, with 3% of oligomer from synthesis 3 and 2% by weight of an anti-wear additive 1.

c) Formulation 8:170-46-F7

Neopolyol ester 2, viscosity at 40° C.=250 $mm^2/s$, with 3% of a mixture of reference alkylated aromatic amine, 1.5% of pp'dioctyl diphenyl amine (Irganox LO1 from Ciba Geigy)+ 1.5% of octyl phenyl alpha naphthylamine (Irganox LO6 from Ciba Geigy) and 2% by weight of an anti-wear additive 1.

B. Test Results

Figure 2:
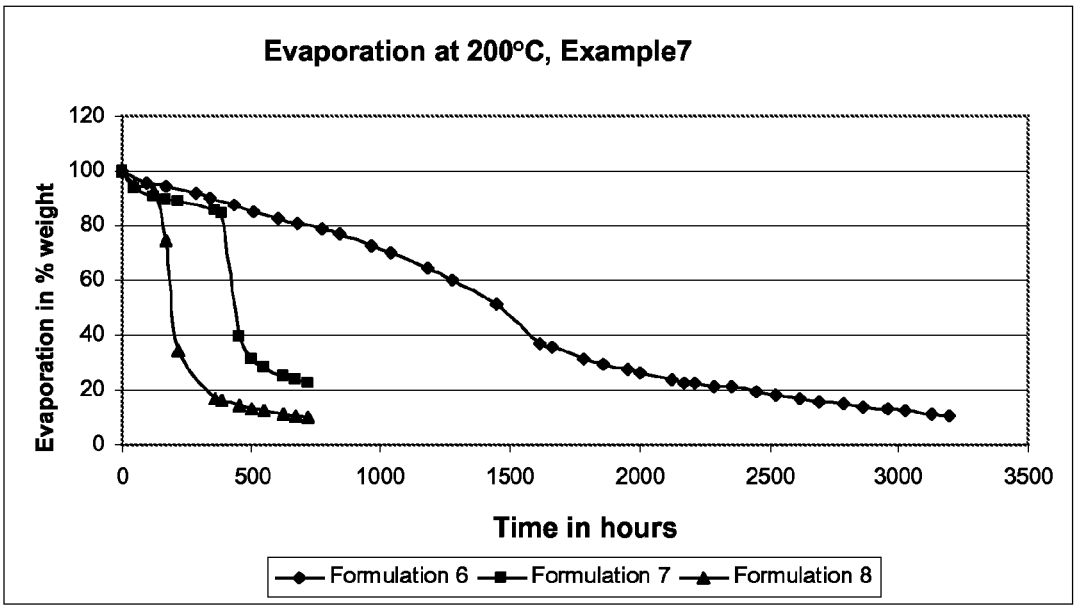
FIG. 2 illustrates the comparison between the evaporation curves of two lubricating compositions of the invention, based on polyol esters, and a comparative lubricating composition based on the same polyol esters. On the abscissa: the time of exposure at high temperatures (200° C.), in hours. On the ordinates: the degree of evaporation, in residual weight percentage, relative to the weight at time 0 of the composition.

The test results are illustrated on FIG. 2 and were obtained through the cup assay as illustrated in Example 6

B.1. Service Life

The results of the FIG. 2 show that all the formulations of lubricating compositions comprising a stabilizing additive based on DPA and PAN oligomers (formulations no 6 and 7) have a significantly improved high temperature resistance capacity, as compared to the comparative formulation 8 which does not contain such additive.

It could be observed that formulation no 7, which shows the lesser improvement, has a capacity to retain its lubricating properties over time that is about 2.5 times longer than the comparative formulation which does not contain any DPA and PAN oligomer-based additive (400 hours versus 150 hours for comparative formulation 8)

It could also be observed that formulation no 6 has a capacity to retain its lubricating properties for a time period about 15 times longer than that of the comparative formulation no 8 (2350 hours versus 150 for comparative formulation 8).

It should be noted that comparative formulation 8 comprises 3% by weight of a mixture of alkylated aromatic amines.

B.2. Decomposition

The results of FIG. 2 show that all the formulations of the invention (formulations no 6 and 7) are able to decompose rapidly. It should be noted however that formulation no 7 has the best capacity to rapidly degrade. By contrast, formulation no 6 has a significantly slower decomposition rate.

In addition, it could be observed that the degradation rate of the formulation no 7 is comparable to or even the same as the degradation rate of the comparative formulation 8.

Furthermore, decomposition of the formulations of the invention (formulations no 6 and 7) causes the formation of a small amount of residues.

Example 8

Comparative Tests for Thermally Stabilizing an Alcohol Trimellitate-based Oil A. Preparation Protocols a) Formulation 9: 170-50-F12

13 C-branched alcohol trimellitate, viscosity at 40° C.=300 $mm^2/s$, with 3% by weight of oligomer from synthesis 3 and 2% by weight of an anti-wear additive 1.

b) Formulation 10: 170-50-F13

13 C-branched alcohol trimellitate, viscosity at 40° C.=300 $mm^2/s$, with 3% of a mixture of reference alkylated aromatic amine, 1.5% of pp'dioctyl diphenyl amine (Irganox LO1 from Ciba Geigy)+1.5% of octyl phenyl alpha naphthylamine (Irganox LO6 from Ciba Geigy) and 2% by weight of an anti-wear additive 1.

B. Test Results

B.1. Service Life

Figure 3:
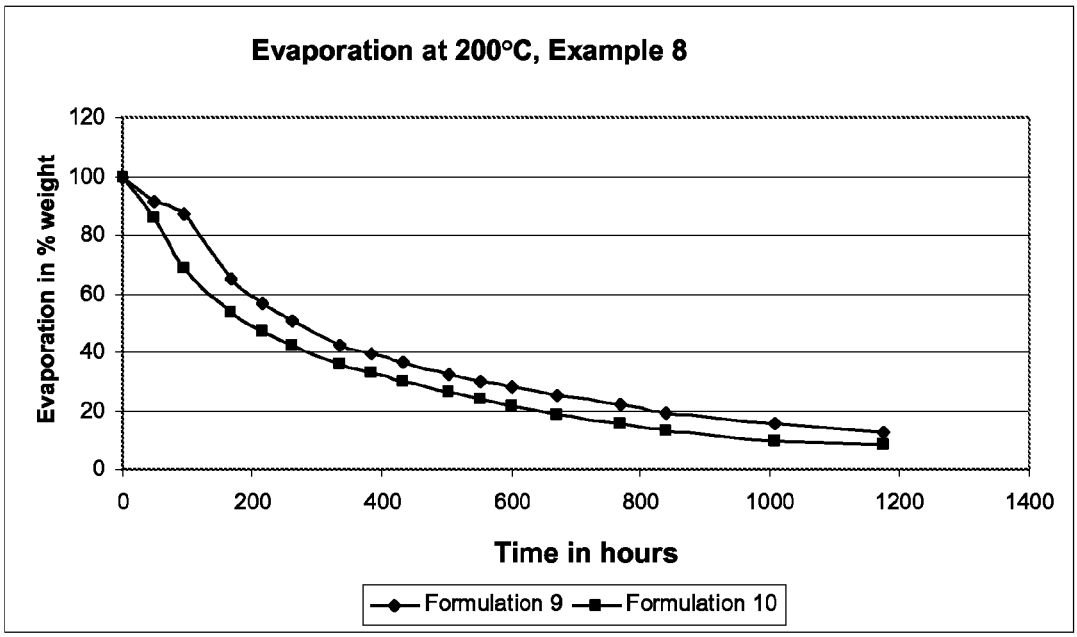
FIG. 3 illustrates the comparison between the evaporation curves of a lubricating composition of the invention, based on an alcohol-derived trimellitate, and a comparative lubricating composition based on the same alcohol-derived trimellitate. On the abscissa: the time of exposure at high temperatures (200° C.), in hours. On the ordinates: the degree of evaporation, in residual weight percentage, relative to the weight at time 0 of the composition.

The test results are illustrated in FIG. 3 and were obtained through the cup assay as illustrated in Example 6.

It should be noted that formulation no 9 comprises 2% by weight of the DPA and PAN oligomer-based additive and that comparative formulation no 10 comprises 3% by weight of a mixture of alkylated aromatic amines.

The results of FIG. 3 show that the formulation of the lubricating composition comprising a stabilizing additive based on DPA and PAN oligomers (formulation no 9) has, for an additive lesser content, a significantly improved lubricating power, as compared to comparative formulation no 10 which comprises an additive based on alkylated aromatic amine monomers.

B.2. Decomposition

The results of FIG. 3 show that the formulation no 9 of the invention has a decomposition rate similar to the decomposition rate of the comparative formulation no 10.

Also, the decomposition of the formulation no 9 of the invention causes residues to be formed in a small amount.

Example 9

Comparative Tests for Lubricating Compositions Based on Polyol Esters and Diacid A. Production Protocols a) Formulation 11: 170-10-F5

Polyester 1. ester of neopolyol complexed with a diacid, viscosity at 40° C. of 320 $mm^2/s$, with 2% by weight of oligomer from synthesis 1 and 2% by weight of an anti-wear additive 1.

b) Formulation 12: 170-10-F6

Polyester 1. ester of neopolyol complexed with a diacid, viscosity at 40° C. of 320 $mm^2/s$, with 3% of a mixture of reference alkylated aromatic amine, 1.5% of pp'dioctyl diphenyl amine (Irganox LO1 from Ciba Geigy)+1.5% of octyl phenyl alpha naphthylamine (Irganox LO6 from Ciba Geigy) and 2% by weight of an anti-wear additive 1.

B. Test Results

B.1. Service Life

Figure 4:
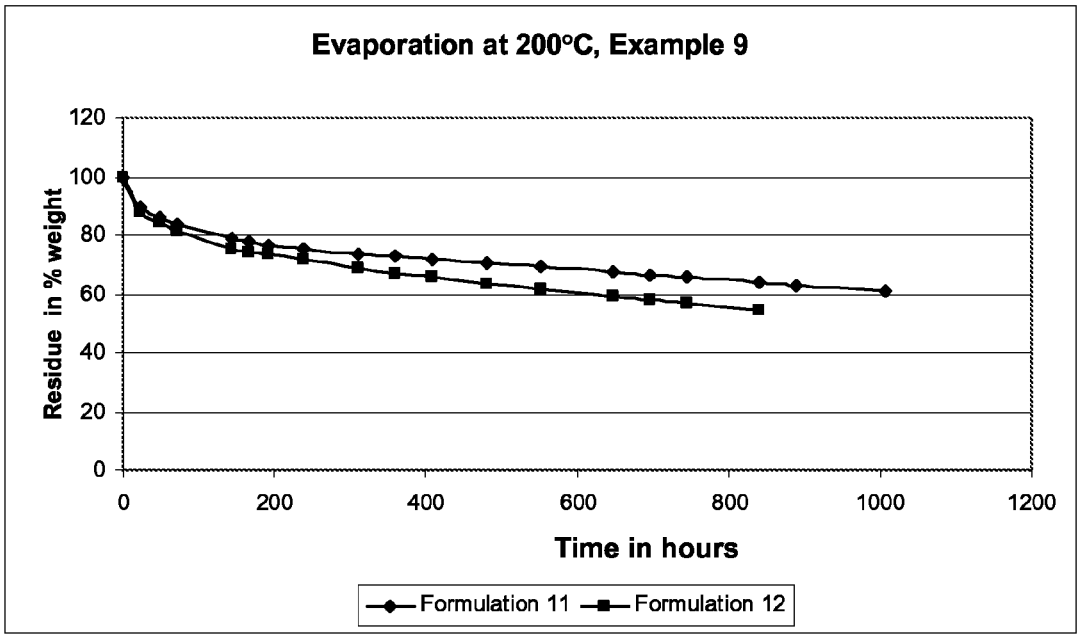
FIG. 4 illustrates the comparison between the evaporation curves of a lubricating composition of the invention, based on polyester and a comparative lubricating composition based on the same polyester. On the abscissa: the time of exposure at high temperatures (200° C.), in hours. On the ordinates: the degree of evaporation, in residual weight percentage, relative to the weight at time 0 of the composition.

The test results are illustrated on FIG. 4 and were obtained through the cup assay as illustrated in Example 6.

It should be noted that formulation no 11 comprises 2% by weight of the DPA and PAN oligomer-based additive and that comparative formulation no 12 comprises 3% by weight of a mixture of alkylated aromatic amines.

The results of FIG. 4 show that the formulation of the lubricating composition comprising a stabilizing additive based on DPA and PAN oligomers (formulation no 11) has, for a smaller content of additive, a significantly improved high resistance temperature, as compared to comparative formulation 12 which comprises an additive based on alkylated aromatic amine monomers.

B.2. Decomposition

The results of FIG. 4 show that formulation no 11 of the invention has a decomposition rate similar to the decomposition rate of the comparative formulation no 12.

Moreover, the decomposition of the formulation no 11 of the invention causes the same residue formation.

Example 10

Comparative Tests for Lubricating Compositions Based on a Diester Complexed with a Dialcohol A. Production Protocols a) Formulation 13: 170-10-F2

Polyester 2. diester complexed with a dialcohol, viscosity at 100° C. of 320 $mm^2/s$, with 2% by weight of oligomer from synthesis 1 and 2% by weight of an anti-wear additive 1.

b) Formulation 14: 170-10-F1

Polyester 2. diester complexed with a dialcohol, viscosity at 100° C. of 320 $mm^2/s$, with 3% of a mixture of reference alkylated aromatic amine, 1.5% of pp'dioctyl diphenyl amine (Irganox LO1 from Ciba Geigy)+1.5% of octyl phenyl alpha naphthylamine (Irganox LO6 from Ciba Geigy) and 2% by weight of an anti-wear additive 1.

B. Test Results

B.1. Service Life

Figure 5:
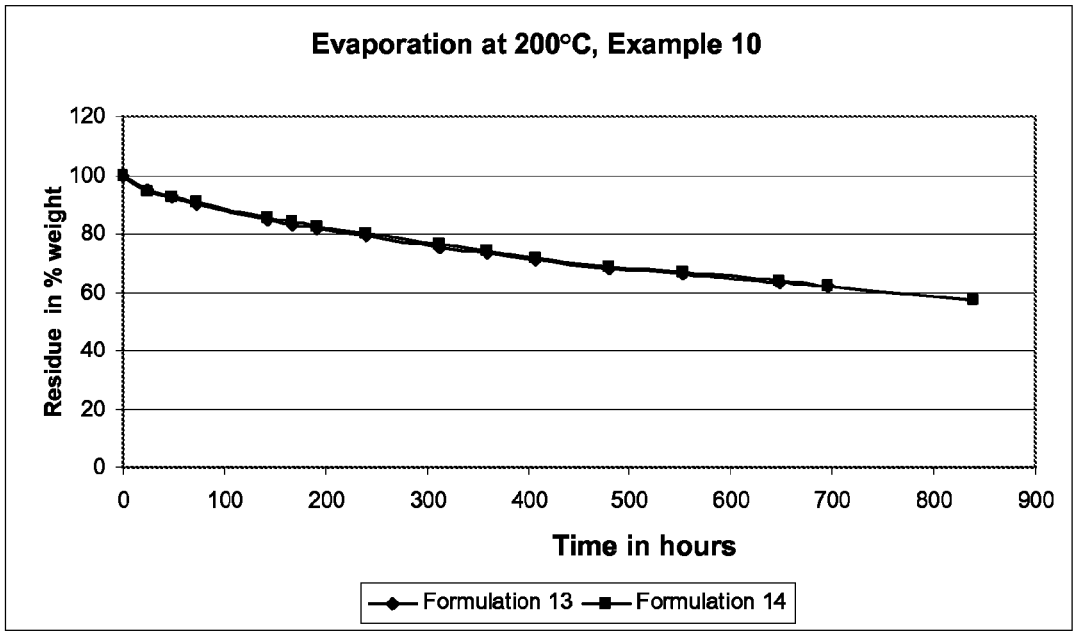
FIG. 5 illustrates the comparison between the evaporation curves of a lubricating composition of the invention, based on polyester with a comparative lubricating composition based on the same polyester. On the abscissa: the time of exposure at high temperatures (200° C.), in hours. On the ordinates: the degree of evaporation, in residual weight percentage, relative to the weight at time 0 of the composition.

The test results are illustrated on FIG. 5 and were obtained through the cup assay as illustrated in Example 6.

It should be noted that formulation no 13 comprises 2% by weight of the DPA and PAN oligomer-based additive and that comparative formulation no 14 comprises 3% by weight of a mixture of alkylated aromatic amines.

The results of FIG. 5 show that the formulation of the lubricating composition comprising a stabilizing additive based on DPA and PAN oligomers (formulation no 13) has, for a smaller content of additive, a significantly improved high resistance temperature, as compared to comparative formulation no 14 which comprises an additive based on alkylated aromatic amine monomers.

B.2. Decomposition

The results of FIG. 5 show that formulation no 13 of the invention has a decomposition rate similar to the decomposition rate of comparative formulation no 14.

Furthermore, the decomposition of the formulation no 13 of the invention causes the same residue formation.

The test results are illustrated on Tables 4 and 5 hereunder.

wherein the group $R_3$ represents a hydrogen or a linear or branched alkyl group having from 1 to 30 carbon atoms, and (iii) the reaction of a (DPA) compound of formula (I) with a (PAN) compound of formula (II), in the presence of potassium permanganate catalyst, said reaction producing an additive comprising:

I) (a) from 0% to 3% by weight of diphenylamine of formula (I),

TABLE 4

| | Example 6 | | | | | Example 7 | | |
|---|---|---|---|---|---|---|---|---|
| | F1 | F2 | F3 | F4 | F5 | F6 | F7 | F8 |
| Stabilizing agent type | Oligomer 1 | Oligomer 3 | Oligomer 2 | Oligomer 5 | traditional | Oligomer 1 | Oligomer 3 | traditional |
| content | 3 | 3 | 3 | 3 | 3 | 3 | 3 | 3 |
| Base type | NPE 3 | NPE 3 | NPE 3 | NPE 3 | NPE 3 | NPE 2 | NPE 2 | NPE 2 |
| Time before polymerization, h | 1850 | 750 | 900 | 1850 | 650 | 2350 | 480 | 200 |
| % of residue | 14 | 20 | 22 | 13 | 18 | 28 | 35 | 20 |

TABLE 5

| | Example 8 | | Example 9 | | Example 10 | |
|---|---|---|---|---|---|---|
| | F9 | F10 | F11 | F12 | F13 | F14 |
| Stabilizing agent type | Oligomer 3 | traditional | Oligomer 1 | traditional | Oligomer 1 | traditional |
| Content, weight % | 3 | 3 | 2 | 3 | 2 | 3 |
| Base type | Trimellitate | Trimellitate | Polyester 1 | Polyester 1 | Polyester 2 | Polyester 2 |
| Time before polymerization, h | 250 | 200 | 550 | 500 | 200 | 250 |
| Residue, weight % | 51 | 47 | 69 | 64 | 80 | 80 |

The invention claimed is:

1. A lubricating composition, comprising:

a base oil and an additive, the additive comprising a mixture of oligomers that is produced from the reaction of aromatic amines selected from the group consisting of:

(i) the reaction of diphenylamine (DPA) compounds with each other, the (DPA) compounds having the formula (I):

(I)

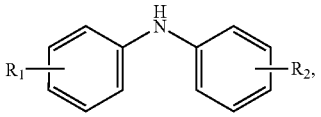

wherein $R_1$ and $R_2$ represent, independently of one another, a hydrogen or a linear or branched alkyl group having from 1 to 30 carbon atoms, (ii) the reaction of phenyl-α-naphthylamine (PAN) compounds with each other, in the presence of potassium permanganate catalyst, the (PAN) compounds having the formula (II):

(II)

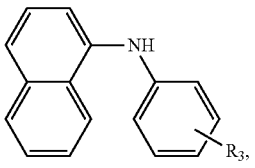

(b) from 0% to 3% by weight of phenyl-α-naphthylamine of formula (II), (c) from 1% to 40% by weight of oligomers in the form of dimers, (d) from 25% to 45% by weight of oligomers in the form of trimers, (e)from 20% to 45% by weight of oligomers in the form of tetramers, (f) from 1% to 25% by weight of oligomers in the form of pentamers, (g) from 0% to 10% by weight of oligomers in the form of hexamers, and (h) from 0% to 10% by weight of oligomers in the form of heptamers or oligomers with a higher degree of polymerization, wherein the percentages by weight are expressed relative to the total weight of the (a)-(h) components;

or an additive comprising:

(II) (a) from 0% to 1% by weight of diphenylamine of formula (I), (b) from 0% to 1% by weight of phenyl-α-naphthylamine of formula (II), (c) from 1% to 5% by weight of oligomers in the form of dimers, (d) from 30% to 45% by weight of oligomers in the form of trimers, (e) from 20% to 35% by weight of oligomers in the form of tetramers, (f) from 10% to 30% by weight of oligomers in the form of pentamers, (g) from 0% to 15% by weight of oligomers in the form of hexamers, and (h) from 0% to 10% by weight of oligomers in the form of heptamers or oligomers with a higher degree of polymerization, wherein the percentages by weight are expressed relative to the total weight of the (a)-(h) components.

2. The lubricating composition according to claim 1, wherein in formula (I), each of $R_1$ and $R_2$ represents an octyl group.

3. The lubricating composition according to claim 1, wherein in formula (II), $R_3$ is an octyl group or an hydrogen atom.

4. The stabilized lubricating composition according to claim 1, wherein said base oil is a mineral oil or a synthetic ester-based oil.

5. The stabilized lubricating composition according to claim 1, wherein said additive is present in the lubricating composition in an amount of 0.1% to 10% by weight, relative to the total weight of the lubricating composition.

6. A method for stabilizing a lubricating composition for a conveyor chain subjected to a temperature of at least 120° C., comprising:

adding to said lubricating composition an additive comprising a mixture of oligomers that is produced from the reaction of aromatic amines selected from the group consisting of:

(i) the reaction of diphenylamine(DPA) compounds with each other, said (DPA) compounds having the formula (I):

(I)

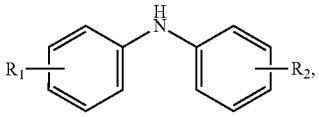

wherein $R_1$ and $R_2$ represent, independently of one another, a hydrogen of a linear or branched alkyl group having from 1 to 30 carbon atoms, (ii) the reaction of phenyl-α-naphthylamine (PAN) compounds with each other, in the presence of potassium permanganate catalyst, said (PAN) compounds having the formula (II):

(II)

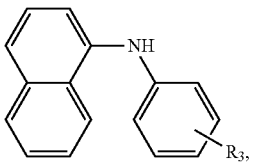

wherein $R_3$ represents a hydrogen or a linear or branched alkyl group having from 1 to 30 carbon atoms, and (iii) the reaction of a (DPA) compound of formula (I) with a (PAN) compound of formula (II), in the presence of potassium permanganate catalyst, said reaction producing an additive comprising:

I) (a) from to weight of diohenylamine of formula (I), (b) from 0% to 3% by weight of phenyl-α-naphthylamine of formula (II), (c) from 1% to 40% by weight of oligomers in the form of dimers, (d) from 25% to 45% by weight of oliqomers in the form of trimers, (e) from 20% to 45% by weight of oligomers in the form of tetramers, (f) from 1% to 25% by weight of oligomers in the form of pentamers, (g) from 0% to 10% by weight of oligomers in the form of hexamers, and (h) from 0% to 10% by weight of oligomers in the form of heptamers or oligomers with a higher degree of polymerization, wherein the percentages by weight are expressed relative to the total weight of the (a)-(h) components;

or an additive comprising:

(II) from 0% to 1% by weight of diphenylamine of formula (I), (b) from 0% to 1% by weight of phenyl-α-naphthylamine of formula (II), (c) from 1% to 5% by weight of oligomers in the form of dimers, (d) from 30% to 45% by weight of oligomers in the form of trimers, (e) from 20% to 35% by weight of oligomers in the form of tetramers, (f) from 10% to 30% by weight of oligomers in the form of pentamers, (g) from 0% to 15% by weight of oligomers in the form of hexamers, and (h) from 0% to 10% by weight of oligomers in the form of heptamers or oligomers with a higher degree of polymerization, wherein the percentages by weight are expressed relative to the total weight of the (a)-(h) components.

7. The method according to claim 6, wherein for the diphenylamine (DPA) compound of formula (I), each of $R_1$ and $R_2$ represents an octyl group.

8. The method according to claim 6, wherein for the phenyi-α-naphthylamine (PAN) compound of formula (II), $R_3$ is an octyl group or an hydrogen atom.

9. The method according to claim 6, wherein said lubricating composition is a mineral oil or a synthetic ester-based oil.

10. The method according to claim 6, wherein the lubricating composition is suitable for lubricatinq a conveyer chain subjected to a temperature of at least 150° C.

11. The method according to claim 6, wherein said additive present in the lubricating ccmposition in an amount of 0.1% to 10% by weight, relative to the total weight of the lubricating composition.

12. The method according to claim 6, wherein the additive is produced by reaction (i) the reaction of diphenyiamine (DPA) compounds with each other, and the reaction produces an additive comprising:

(a) from 0% to 30% by weight of diphenylamine of formula (I), (b) from 0% to 1% by weight of phenyl-α-naphthylamine of formula (II), (c) from 1% to 95% by weight of oligomers in the, form of dimers of DPA, (d) from 0% to 35% by weight of oligomers in the form of trimers of DPA, (e) from 0% to 35% by weight of oligomers in the form of tetramers of DPA (f) from 0% to 30% by weight of oligomer in the form of pentamers of(DPA), (g) from 0% to 10% by weight of oligomers in the form of hexamers of DPA, and (h) from 0% to 10% by weight of oligomers in the form of heptamers of DPA or oligomers with a higher degree of polymerization, wherein the percentages by weight are expressed relative to the total weight of the (a)-(h) components.

13. The method accordinq to claim 6, wherein in formulae (I) and (II), $R_1$, $R_2$ and $R_3$ independently represent a hydrogen or a linear or branched alkyl group having from 4 to 12 carbon atoms.

14. The lubricating composition according to claim 1, wherein in formulae (I) and (II), $R_1$, $R_2$ and $R_3$ independently represent a hydrogen or a linear or branched alkyl group having from 4 to 12 carbon atoms.

* * * * *